United States Patent [19]

Cherry et al.

[11] 4,267,530

[45] May 12, 1981

[54] IRIS FOR RECEIVER PROTECTOR

[75] Inventors: William D. Cherry, Beltsville; Harry Goldie, Randallstown, both of Md.

[73] Assignee: Westinghouse Electric Corp., Pittsburgh, Pa.

[21] Appl. No.: 61,129

[22] Filed: Jul. 26, 1979

[51] Int. Cl.[3] ..... H01P 1/14; H01P 1/08

[52] U.S. Cl. ..... 333/13; 333/252

[58] Field of Search ..... 333/13, 99 P, 252, 248, 333/219, 253

[56] References Cited

U.S. PATENT DOCUMENTS

| | | | |
|---|---|---|---|
| 2,697,800 | 12/1954 | Roberts | 333/13 UX |
| 2,834,949 | 5/1958 | Duffy | 333/13 X |
| 2,972,083 | 2/1961 | Walker et al. | 333/13 X |
| 3,648,100 | 3/1972 | Goldie et al. | 333/13 UX |
| 3,753,158 | 8/1973 | Prescott | 333/13 |

*Primary Examiner*—Paul L. Gensler

*Attorney, Agent, or Firm*—R. M. Trepp

[57] ABSTRACT

An iris for a stage of a receiver protector is described incorporating a metal plate having a slot opening wherein the electric field across the slot opening is enhanced by tapering or beveling the edges of the slot.

The invention overcomes the problem of high firing threshold and high recovery time of a gas plasma by providing metal in close proximity to the gap for providing free electrons.

3 Claims, 7 Drawing Figures

IRIS FOR RECEIVER PROTECTOR

GOVERNMENT CONTRACT

The government has rights in this invention pursuant to contract number F33615-74-C-1040 awarded by the Department of the Air Force.

CROSS-REFERENCE TO A RELATED APPLICATION

This application is cross-referenced to an application entitled "Receiver Protector" by H. Goldie having Ser. No. 061,128, identified as Westinghouse Case No. 48,396 filed on July 26, 1979 which describes an improved receiver protector having or incorporating an iris to attenuate out of band frequencies generated by non-linear elements within the receiver protector, namely, the gas plasma stages.

BACKGROUND OF THE INVENTION

1. Field of the Invention

This invention relates to receiver protectors, particularly to an iris for a gas discharge stage in a receiver protector.

2. Description of the Prior Art

Receiver protectors are used in the microwave duplexing art for permitting the use of a single antenna for transmission of high power output pulses and reception of low power received signals via a common microwave waveguide. Plasma within the receiver protector automatically inhibits the transmission of high power wide bandwidth electromagnetic wave energy in the direction from the antenna to the receiver thus preventing the transmitted pulse from reaching and damaging the receiver. The receiver protector also permits the low power receive signal to come from the antenna through the microwave waveguide to be routed to the receiver. In U.S. Pat. No. 4,027,255 issued on May 31, 1977 to H. K. Blakeney, et al. and assigned to the assignee herein, a three stage receiver protector is described having two gas plasma stages and a diode limiter stage. The second gas plasma stage comprises a first metal gap formed by truncated cones facing one another and a second metal gap formed by an inverted truncated cone and a cone. The cross section of the truncated cone at the gap may be in the range of 0.05 to 0.102 centimeters in diameter with a gap spacing of approximately 0.038 centimeters. When the electromagnetic energy in the gap between a cone and a truncated cone exceeds a firing threshold due to the ionization of the gas, current will flow between the cones short circuiting the waveguide and reflecting energy back towards the input. The reflected energy increases the electromagnetic power density between the two truncated cones which will short circuit when the power density exceeds the firing threshold. The gas selected for the dual cone stage may be a negative attaching gas to permit rapid recovery by extinguishing the gas plasma when the power density in the gaps fall below predetermined levels. Recovery time of the gas plasma or the elimination of gas ions by recombination with electrons is hampered by the limited conducting area of the cones in close proximity to the gap which provide a source of free electrons for recombination with the ions in the gap.

An iris in a waveguide has been used in the prior art to control the passage of electromagnetic energy of a predetermined frequency. In U.S. Pat. No. 2,407,069 issued in 1946 to Fiske a dumbbell iris is described having two circular openings connected by an elongated slot. The two circular openings provide inductance and the elongated slot provides capacitance to form a resonant L-C-L circuit.

It is therefore desirable to reduce the firing threshold of a stage of a receiver protector by utilizing an iris.

It is further desirable to improve the recovery time of a gas plasma in a glass plasma stage of a receiver protector by increasing the area of conducting metal in close proximity of the gap to provide free electrons.

It is further desirable to modify the electric field across the gap of a dumbbell iris to reduce the firing threshold for shunting electromagnetic, radio frequency or microwave power across the gap.

SUMMARY OF THE INVENTION

In accordance with the present invention, an iris is provided for a stage of a receiver protector comprising a metal plate having a first and second side and two spaced apart circular openings conducted by a slot opening having a predetermined gap formed by a first and second edge, the first and second edges having flat areas positioned opposite one another and tapered surface areas contiguous to the flat areas.

The invention further provides an intermediate stage of a receiver protector comprising a waveguide suitable for propagating electromagnetic energy, a gas suitable for forming a gas plasma discharge, means for holding the gas within the predetermined volume of the waveguide, and an iris positioned within the predetermined volume and transverse to the waveguide, the iris including a metal plate having a first and second side and two spaced apart circular openings connected by a slot opening, the slot opening having a predetermined gap formed by a first and second edge, the first and second edges having flat areas positioned opposite one another and tapered surface areas contiguous to the flat areas.

DESCRIPTION OF THE PREFERRED EMBODIMENT

Figure 1:
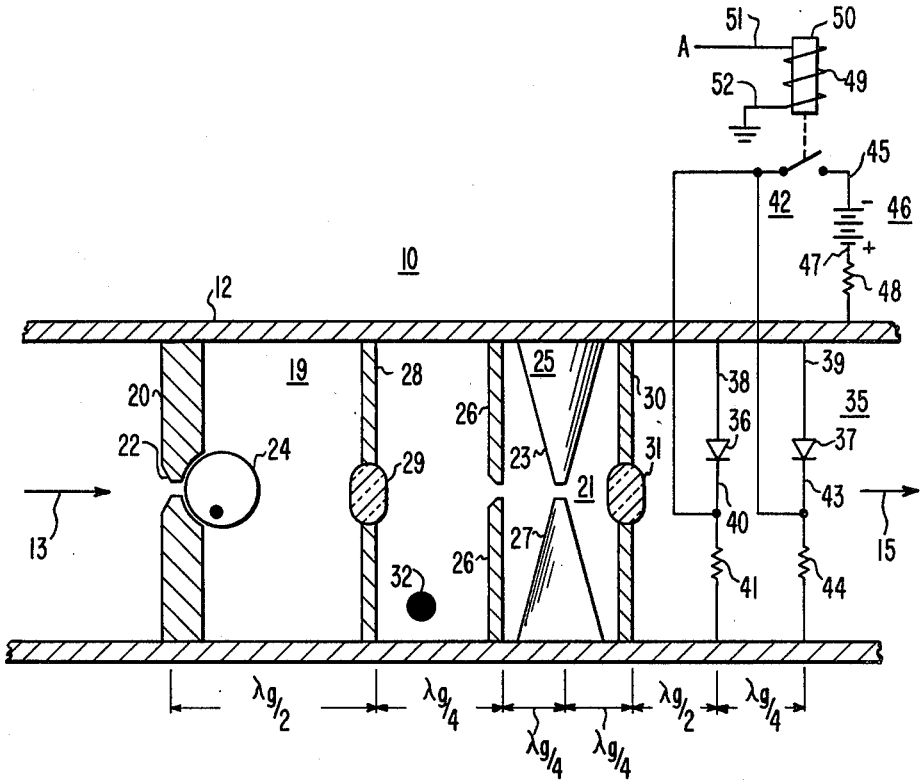
FIG. 1 is one embodiment of the invention.

Referring now to the drawing and in particular to FIG. 1 a multistage receiver protector 10 comprises a waveguide 12 which may be, for example, rectangular having an input end indicated by arrow 13 and an output end indicated by arrow 15. Waveguide 12 is suitable for propagating electromagnetic energy through waveguide 12 from arrow 13 to arrow 15. The electromagnetic input energy indicated by arrow 13 which may be, for example, radio frequency or microwave energy is conventionally introduced by arrangement of the radar antenna connected to a circulator duplexer arrangement having a "port four" connection to the receiver circuit. Another port of the circulator is connected to the transmitter, and still another port is connected to a suitable load for properly terminating impedances. Electromagnetic energy indicated by arrow 13 passes through slot 22 in iris 20. The upper and lower edges of slot 22 of iris 20 are tapered as shown in FIG. 1. A vial type chlorine gas discharge power limiter 24 is recessed in the rear side of iris 20 in alignment with the slot 22. Limiter 24 has a predetermined minimum power sustaining characteristic which may for example be 400 watts. Minimum sustaining power of limiter 24 is the minimum power to keep the discharge device safely turned on.

Waveguide 12 has a second limiter stage 25, comprising iris 26 which is positioned transverse waveguide 12 followed by a discharge gap 21 formed by two truncated cones 23 and 27 positioned opposite each other. Walls 28 and 30 are positioned transverse to waveguide 12 and provide a means for holding gas within the volume between walls 28 and 30 and bounded by waveguide 12. Window 29 in walls 28 permits electromagnetic energy to pass through from the preceding first stage 19 containing limiter 24. Window 31 permits electromagnetic energy to pass through wall 30. Iris 20 and wall 28 are positioned $\lambda_g/2$ apart where $\lambda_g$ is at a predetermined center frequency $f_o$ of electromagnetic energy suitable for propagation in waveguide 12. Iris 26 is positioned $\lambda_g/4$ from wall 28. Gap 21 formed by cones 23 and 27 is positioned $\lambda_g/4$ from iris 26 towards the output end of waveguide 12. Wall 30 is spaced $\lambda_g/2$ from iris 26. Within the volume between walls 28 and 30 is a gas 32 suitable for generating a gas plasma discharge.

Following the second stage limiter 25 is a third stage limiter 35 comprising diodes 36 and 37 having their anodes coupled to waveguide 12 over lines 38 and 39 respectively. Diode 36 may be positioned $\lambda_g/2$ from wall 30 towards the output end of waveguide 12. Diode 37 may be positioned $\lambda_g/4$ from diode 36 towards the output end of waveguide 12. The cathode of diode 36 is coupled over line 40 to one side of resistor 41 and to one side of switch 42. The cathode of diode 37 is coupled over line 43 to one side of resistor 44 and to one side of switch 42. The other side or resistors 41 and 44 are coupled to waveguide 12. The other side of switch 42 is coupled over line 45 to one side of battery 46 which has a potential of for example five volts. Battery 46 may for example be a voltage or power supply. The other side of battery 46 is coupled over line 47 through resistor 48 to waveguide 12. Resistors 41 and 44 may for example be 20 ohms and resistor 48 may have a selected value such that 80 milliamperes will flow when switch 42 is closed.

Switch 42 is controlled by solenoid 49 having a coil 50 having one end coupled over line 51 to control signal A and the other end coupled over line 52 to ground potential. Solenoid 49 functions in response to control signal A to open or close switch 42. By selectively opening and closing switch 42 the third stage limiter 35 will have its diodes biased or gated on to provide limiting action upon electromagnetic, microwave or radio frequency (rf) power passing through the third limiter stage 35. Control signal A therefore acts as a gating signal for third stage limiter 35.

Figure 2:
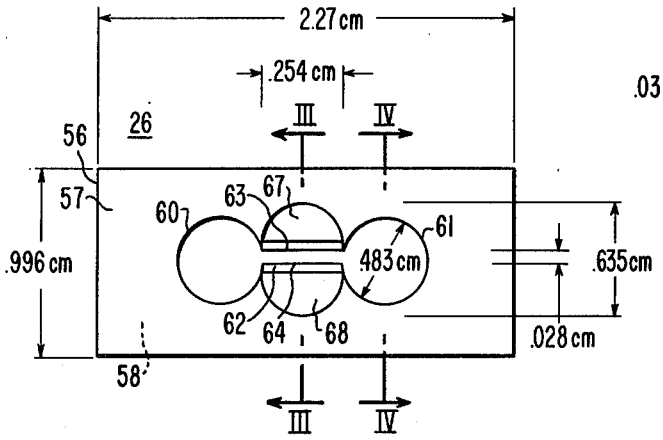
FIG. 2 is a front view of an iris used in FIG. 1.

Referring now to FIG. 2, a front view of iris 26 from FIG. 1 is shown in more detail. Iris 26 includes a metal plate 56 having a first side 57 and a second side 58. Metal plate 56 may be, for example, Kovar, nickel, copper, stainless steel, aluminum or any vacuum tube compatible material. Metal plate 56 has two spaced apart openings 60 and 61 connected by a slot or aperture opening 62. The slot opening 62 has a predetermined gap formed by a first edge 63 and a second edge 64. As shown in FIG. 2 the gap or space between edges 63 and 64 of slot opening 62 is 0.028 centimeters. The diameter of circular openings 60 and 61 are 0.483 centimeters. The length of slot opening 62 connecting circular openings 60 and 61 as shown in FIG. 2 is 0.254 centimeters. Plate 56 has outside dimensions of 0.996 centimeters and 2.27 centimeters which conform to the inside of rectangular waveguide 12.

As shown in FIG. 2, metal plate 56 further includes two semicircular counterbores 67 and 68 formed in first side 57 and positioned adjacent edges 63 and 64 of slot opening 62. The semicircular counterbores 67 and 68 may assume other geometries and primarily functions to narrow the overall thickness of plate 56 in the proximity of edges 63 and 64. The reduction and thickness of edges 63 and 64 results in the reduction in capacitance across gap 62.

Figure 3:
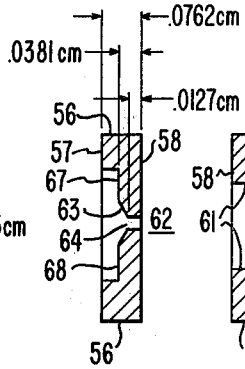
FIG. 3 is a cross section view along the lines III—III of FIG. 2.

FIG. 3 is a cross section view along the lines III—III of FIG. 2 showing in more detail counterbores 67 and 68, edges 63 and 64 and slot opening 62.

Figure 4:
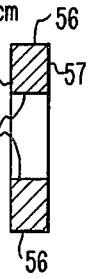
FIG. 4 is a cross section view along the lines IV—IV of FIG. 2.

FIG. 4 is a cross section view along the lines IV—IV of FIG. 2 which shows circular opening 61 in metal plate 56.

Figure 5:
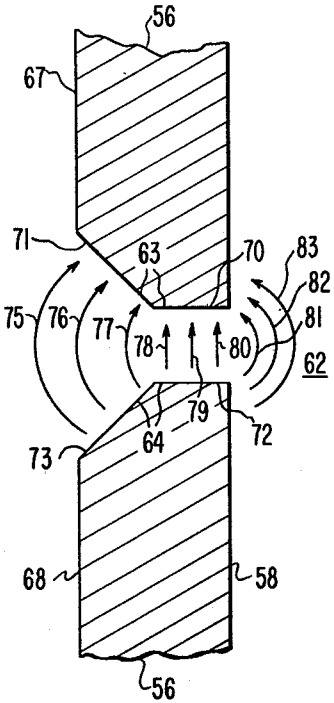
FIG. 5 is an enlarged view of a portion of FIG. 3.

FIG. 5 is an enlarged view of a portion of FIG. 3 showing the profile or contour of edges 63 and 64 across slot opening 62. In FIG. 5 edge 63 has a flat area 70 and a tapered surface area 71 contiguous to flat area 70. Edge 64 has a flat area 72 and a tapered surface area 73 contiguous to flat area 72. As shown in FIG. 5 flat areas 70 and 72 are positioned opposite one another which form a capacitance across slot opening 62. The capacitance is determined by the area of flat areas 70 and 72 and the distance apart or the gap between flat areas 70 and 72. Tapered surface areas 71 and 73 enhance the electric field in the area of the gap as shown by arrows 75 through 83. The electric field between tapered surface areas 71 and 73 are shown by arrows 75 through 77. The electric field between flat areas 70 and 72 are shown by arrows 78 through 80. The electric field across slot opening 62 originating from second side 58 is shown by arrows 81 through 83.

Tapered surface areas 71 and 73 enhance the electric field in the gap shown by arrows 78 through 80 and extending from side 58 across the gap shown by arrows 81 through 83.

The taper geometry shown in FIG. 5 provides reduced firing threshold, the electromagnetic energy needed to generate a gas plasma discharge across gap 62, while reducing recovery time relative to the recovery time of a conventional second stage limiter using dual cones. In other words, the effect of tapering the edges of the slot of the iris 26 was to couple the E-field more efficiently to the neutral gas molecules. The increased coupling reduced the firing thresholds and produced a more stable pulse-to-pulse discharge. The above discussion is also applicable to the tapered edge of iris 20 shown in FIG. 1. The sharpened or tapered edges over the length of slot opening 62 and the length of the slot opening of 0.254 centimeters was optimized by a series of experiments which gave rise to a 2:1 improvement in firing threshold and leakage spikes. The circular openings 60 and 61 form the inductance which resonates with the "knife edge" capacitance plates 63 and 64 to yield a necessary $Q_1$ of 4.45 where $Q_1$ is the ratio of 0.169 $f_o$ to the bandwidth where the voltage standing wave ratio (VSWR) is below or equal to 1.4 above and below $f_o$. The flat areas 70 and 72 of edges 63 and 64 which form the capacitor also provides readily available surfaces for free electrons to diffuse to the plasma when the microwave pulse passing through iris 26, slot opening 62, terminates resulting in rapid recovery or extinguishing of the gas plasma discharge. The recovery period is therefore enhanced relatively to a conventional dual cone transmit-receive gas stage at equal gas admixtures and radio frequency.

Experimental data taken for a receiver protector 10 as shown in FIG. 1 having an iris 26 as shown in FIG. 2 is shown in Table I. The incident radio frequency power levels were 0.2, 2 and 15 kilowatts. Table I shows leakage power in milliwatts/time interval (nanoseconds) where the third stage 35 was gated on by control signal A at the same rate as the rf pulse.

Table II shows leakage power through receiver protector 10 as in Table I except the third stage limiter 35 was ungated.

TABLE I

| | Gated Leakage | | |
|---|---|---|---|
| Power Incident (kw) | .2 | 2 | 15 |
| Leakage | 30mw/5ns | 70mw/3ns | 70mw/3ns |
| | 35/5 | 75/3 | 82/3 |
| | 30/5 | 120/3 | 265/3 |
| | 30/6 | 85/3 | 150/3 |
| | 15/7 | 50/3 | 90/3 |
| | 30/5 | 110/3 | 150/3 |
| | 35/4 | 100/3 | 150/3 |
| | 15/5 | 60/3 | 90/3 |
| | 20/5 | 70/3 | 75/3 |
| | 35/4 | 110/3 | 190/3 |
| | 15/5 | 70/3 | 125/3 |
| | 35/4 | 125/3 | 200/3 |
| | 25/5 | 90/3 | 130/3 |
| | 30/5 | 105/3 | 110/3 |
| | 15/7 | 90/3 | 185/3 |
| | 30/6 | 95/3 | 125/3 |
| | 20/6 | 50/3 | 50/4 |
| | 30/5 | 90/3 | 125/3 |
| | 15/6 | 90/3 | 90/3 |
| | 20/6 | 100/3 | 225/2.5 |
| | 15/6 | 35/4 | 50/3 |

TABLE II

| | Ungated Leakage | | |
|---|---|---|---|
| Power Incident (kw) | .2 | 2 | 15 |
| Leakage | 15mw/6ns | 60mw/3ns | 60mw/3ns |
| | 25/5 | 70/3 | 32/3 |
| | 18/7 | 75/3 | 110/3 |
| | 20/8 | 70/3 | 100/3 |
| | 15/7 | 40/3 | 40/3 |
| | 25/6 | 80/4 | 90/3 |
| | 20/7 | 70/4 | 100/3 |
| | 15/5 | 30/5 | 40/5 |
| | 20/5 | 60/4 | 60/4 |
| | 30/5 | 100/3 | 120/3 |
| | 11/7 | 40/4 | 110/3 |
| | 20/5 | 80/3 | 140/3 |
| | 20/5 | 60/3 | 90/3 |
| | 25/5 | 60/3 | 60/3 |
| | 15/7 | 65/3 | 110/3 |
| | 20/7 | 70/3 | 90/3 |
| | 15/7 | 50/3 | 55/3 |
| | 20/6 | 70/3 | 80/3 |
| | 20/6 | 50/3 | 65/3 |
| | 15/7 | 100/3 | 95/3 |
| | 15/6 | 30/4 | 50/4 |

Note that the spike leakage in Table I up to 2 kilowatts incident power averages 80 milliwatts peak leakage over 3.5 nanoseconds which equals 2.8 milliergs. This value is considered quite safe for low noise 0.5 micron gate length field effect transistors.

Figure 6:
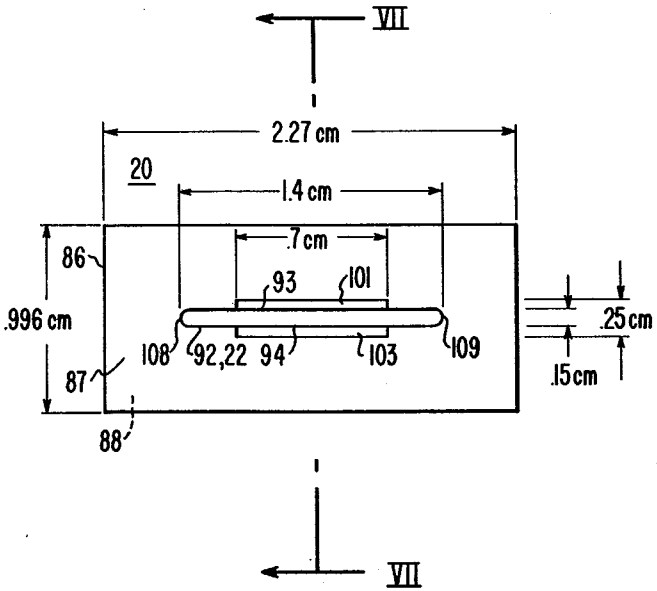
FIG. 6 is a front view of an iris used in FIG. 1.

Referring now to FIG. 6, a front view of iris 20 from FIG. 1 is shown in more detail. Iris 20 includes a metal plate 86 having a first side 87 and a second side 88. Metal plate 86 may be for example cold bar, nickel, copper, stainless steel, aluminum or any vacuum tube compatible material. Metal plate 86 has a slot opening 92. Slot opening 92 has a predetermined gap formed by first edge 93 and second edge 94. As shown in FIG. 6 the gap or space between edges 93 and 94 of slot opening 92 is 0.15 cm. The length of slot opening 92 which has parallel edges and semicircular ends shown in FIG. 6 is 1.4 centimeters. Plate 86 has outside dimensions of 0.996 centimeters and 2.27 centimeters in the form of a rectangle which conform to the inside of rectangular waveguide 12.

Figure 7:
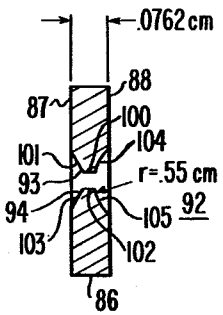
FIG. 7 is a cross section view along the lines VII—VII of FIG. 6.

FIG. 7 is a cross-section view along the lines VII—VII of FIG. 6 showing in more detail edges 93 and 94 and slot opening 92. In FIG. 7 edge 93 has a flat area 100 and a tapered surface area 101 contiguous to flat area 100. Tapered surface 101 is also contiguous to side 87. A curved surface area 104 is contiguous between flat area 100 and side 88 which may have for example a radius of curvature of 0.557 centimeters which is concave for close positioning of vial 24. Edge 94 has a flat area 102 and a tapered surface area 103 contiguous between flat area 102 and tapered surface area 103. Edge 94 also has curved surface area 105 positioned between and contiguous to flat area 102 and side 88. As shown in FIG. 7 flat areas 100 and 102 are positioned opposite one another which form a capacitance across slot opening 92. The capacitance is determined by the flat areas 100 and 102 and the distance apart for the gap between flat areas 100 and 102. Tapered surface areas 101 and 103 enhance the electric field in the area of the gap 92 to couple the electric field more efficiently to the gas molecules in vial 24. The increased coupling reduced the firing thresholds and produced a more stable pulse-to-pulse discharge.

An iris for a stage of a receiver protector has been described incorporating a metal plate having a first and second side and a slot opening, the slot opening having a predetermined gap formed by first and second edge, the first and second edges having flat areas positioned opposite one another and tapered surface areas contiguous to the flat areas.

We claim:

1. An intermediate stage of a receiver protector comprising:

a waveguide suitable for propagating electromagnetic energy;

a gas suitable for forming a gas plasma discharge;

means for holding said gas within a predetermined volume of said waveguide; and an iris positioned within said predetermined volume and transverse to said waveguide, said iris including a metal plate having a first and second side and two spaced apart circular openings connected by a slot opening, said slot opening having a predetermined gap formed by a first and second exposed edge, said first and second edges having flat areas positioned opposite one another and tapered surface areas contiguous to said flat areas to enhance the electric field in the area of said gap, said iris and gas responsive to electromagnetic energy in a predetermined frequency range and of a predetermined power level to generate a gas plasma discharge across said slot opening.

2. An iris for providing at times a gas plasma discharge in a stage of a receiver protector comprising:

a metal plate having a first and second side and two spaced apart circular openings connected by a slot opening;

said slot opening having a predetermined gap formed by a first and second edge;

said first and second edges having flat areas positioned opposite one another and tapered surface areas contiguous to said flat areas to enhance the electric field in the area of said gap.

3. The iris of claim 2 further including two semicircular counterbores formed in said first side of said metal plate and positioned adjacent either edge of said slot opening.

* * * * *